US008059002B2

(12) United States Patent
Chen

(10) Patent No.: US 8,059,002 B2
(45) Date of Patent: Nov. 15, 2011

(54) POOL GUARD ALARM APPARATUS

(76) Inventor: Mike Chen, Irvine, CA (US)

( * ) Notice: Subject to any disclaimer, the term of this patent is extended or adjusted under 35 U.S.C. 154(b) by 492 days.

(21) Appl. No.: 12/219,644

(22) Filed: Jul. 25, 2008

(65) Prior Publication Data

US 2010/0019911 A1 Jan. 28, 2010

(51) Int. Cl.
*G08B 23/00* (2006.01)

(52) U.S. Cl. ..... 340/573.6

(58) Field of Classification Search ..... 340/500, 340/540, 573.1, 573.6, 541, 545.1, 545.2; 200/522

See application file for complete search history.

(56) References Cited

U.S. PATENT DOCUMENTS 3,725,887 A * 4/1973 Sneider ..... 340/539.3
4,124,847 A * 11/1978 Cashman ..... 340/548
4,394,584 A * 7/1983 Spahni et al. ..... 307/117
4,851,814 A * 7/1989 Rehberg ..... 340/546
4,888,578 A * 12/1989 Conemac ..... 340/546
5,473,310 A * 12/1995 Ko ..... 340/547
5,525,963 A * 6/1996 Purssey ..... 340/540
2004/0119588 A1* 6/2004 Marks ..... 340/539.1
2006/0214805 A1* 9/2006 Boujon ..... 340/573.1
2010/0019911 A1* 1/2010 Chen ..... 340/573.6
2010/0097205 A1* 4/2010 Script ..... 340/539.1

* cited by examiner

*Primary Examiner* — Brian Zimmerman
*Assistant Examiner* — An Nguyen
(74) *Attorney, Agent, or Firm* — Bacon & Thomas, PLLC

(57) ABSTRACT

A pool guard alarm apparatus includes an alarm body, a triggering device and a relative triggering element. The alarm body accommodates a circuit board and a battery for providing a power source. The circuit board is provided with several buttons and a sound member. The buttons enable an authorized person to bypass the alarm mode. The triggering device located at the entrance to the pool has a movable part which is elastic to be against the relative triggering element. The moveable part will produce a triggering signal to the circuit board when the entrance is opened. The circuit board activates the sound member to produce an alarm sound after a predetermined time. The alarm sound is repeated after a period of time while in the alarm mode. When the entrance is then closed, the user must reset a pass code to activate the said alarm mode.

15 Claims, 4 Drawing Sheets

POOL GUARD ALARM APPARATUS

BACKGROUND OF THE INVENTION

1. Field of the Invention

The present invention relates to a pool guard alarm apparatus, and more particularly to an alarm apparatus that is effective in preventing unauthorized persons from entering an area around a pool and sounds an alarm when a person enters the protected pool area.

2. Description of the Prior Art

It is an important security management to prevent a stranger or young child from entering an area around an outdoor pool. Sometimes, accidents occur. It is especially dangerous for infants and younger children to enter the pool area when there is no lifeguard or other supervision present. Most outdoor pools have a pool gate for entrance to the pool area. In practice, the gate is often opened by unauthorized persons. Therefore, a simple and effective device is provided at the door or gate that will sound an alarm as soon as the gate is opened.

A conventional pool guard alarm, as disclosed in U.S. Pat. No. 5,473,310, comprises a sensor composed of a magnet and a magnetic switch to detect the entrance of an area around a pool, a high output alarm unit having a delay timer activated via a battery, a housing to accommodate the alarm and the battery, and a reset button located on the housing. The housing and the sensor are located at the entrance to the pool area. The reset button must be pressed within a short time after opening and passage through, or an alarm is sounded whether or not the gate was closed. This design prevents unauthorized persons from entering the pool area and sounds the alarm as soon as the unauthorized persons enter the protected area. There are several disadvantages in the design of the aforesaid patent:

1. An iron gate decreases the magnetism of the trigger, as well as interfering with the magnetic switch, which causes the sensor to malfunction and cause a false alarm.
2. The sensor uses the magnet to attract and activate the magnetic switch. The magnetic switch can easily be out of the scope of the magnetism of the magnet due to wind or other external forces, which may produce an inadvertent contact which will influence the precision of the alarm.
3. This alarm uses a single reset button to bypass the alarm mode. This limits the effectiveness of the protection of the area since anyone can simply push the button to enter without sounding the alarm.

Accordingly, the inventor of the present invention has devoted himself based on his many years of practical experiences to the development of a pool guard alarm apparatus to overcome the above shortcomings.

SUMMARY OF THE INVENTION

A primary purpose of the present invention is to provide a pool guard alarm apparatus, which has a more sophisticated bypass system to more effectively prevent unauthorized persons from entering the protected area around a pool.

Another feature of the present invention is to provide a pool guard alarm apparatus, which will produce a different sound that will repeat after a period of time to remind the user to close the gate after the gate is opened and before the gate is closed.

Another featured upgrade of the present invention is to provide a pool guard alarm apparatus, which utilizes a mechanical contact operation to open the gate to eliminate the occurrence of false alarms. Said mechanical operation is also simpler in design, more cost effective and easier to maintain.

To achieve the aforementioned purposes of the present invention, the pool guard alarm apparatus comprises an alarm body having a case to accommodate a circuit board and a battery for providing a power source. The circuit board comprises several buttons and a sound member. The buttons protrude outward from the case for an operator to key in a pass code and bypass the alarm system. The triggering element is located on either of a gate and a doorframe at the entrance of an area around a pool. A triggering device is located on either of the gate and the doorframe, corresponding to the triggering element. The triggering device has a movable part which is elastic and retractable to change an engaging state with respect to the relative triggering element upon opening or closure of the gate, thereby producing a triggering signal to the circuit board. The circuit board under an alarm mode activates the sound member to produce an alarm sound after a predetermined time.

According to the aforementioned structure, the alarm sound is repeated after a period of time while in the alarm mode.

According to the aforementioned structure, the circuit board drives the sound member to produce a different alarm sound when the alarm mode is lifted and the gate is open.

The aforesaid purposes, efficacy and features will become apparent to those skilled in the art from the following detailed description and the drawings referenced herein.

DETAILED DESCRIPTION OF THE INVENTION

Figure 1:
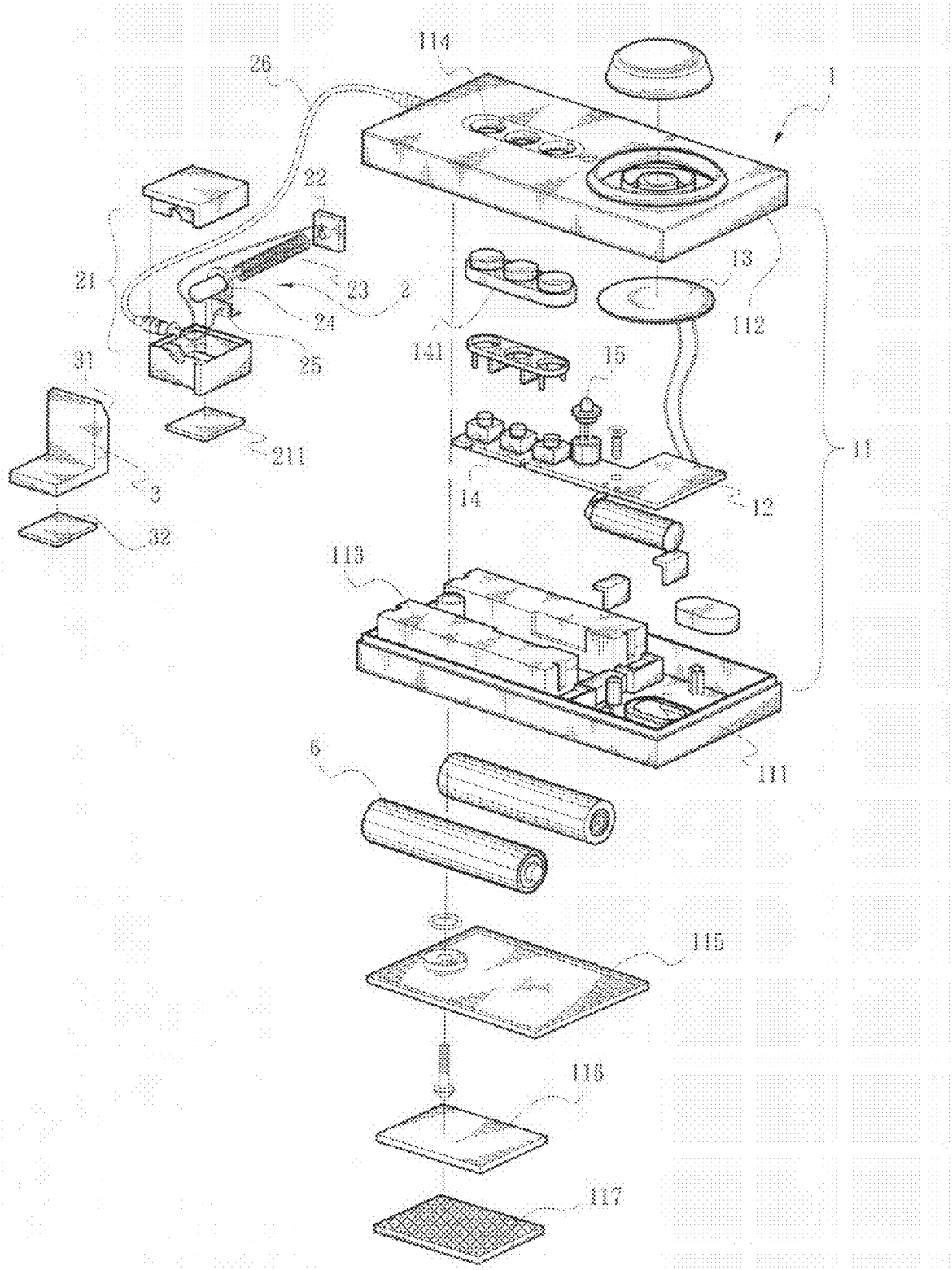
FIG. 1 is an exploded view of the present invention.
Figure 2:
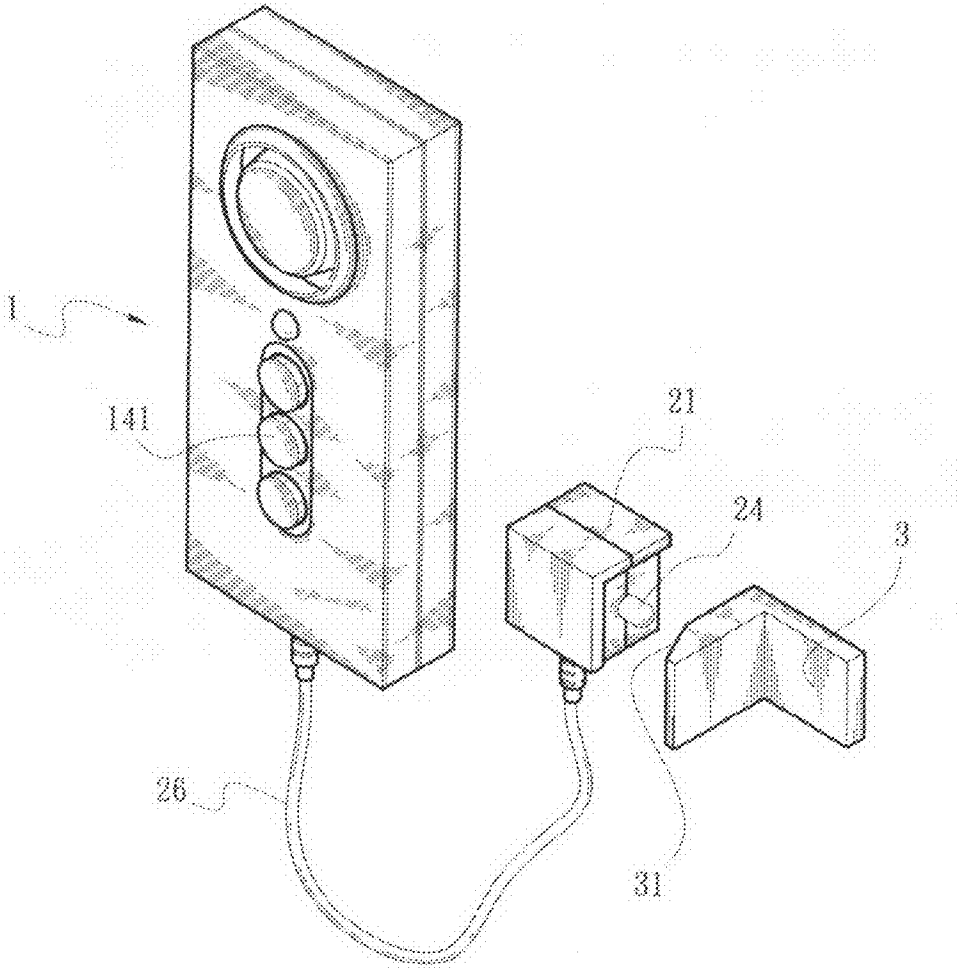
FIG. 2 is a perspective view of the present invention after assembly.

As shown in FIGS. 1 and 2, the present invention comprises an alarm body 1, a triggering device 2, and a relative trigging element 3.

The alarm body 1 has a case 11 composed of a lid 112 and a base 111 to accommodate at lease a circuit board 12. The circuit board 12 comprises a plurality of buttons 14, at least an illuminating member 15, and a sound member 13. The illuminating member 15 may be a light emitting diode. The sound member 13 may be a buzzer. The base 111 comprises a battery room 113 having an opening facing downward to accommodate a battery 6 therein. A detachable cover 115 is adapted to cover the opening of the battery room 113. The lid 112 is formed with a plurality of apertures 114 corresponding in position to the buttons 14. A button cover 141 fits onto the buttons 14. The buttons 14 protrude from the apertures 114 of the lid 112 for a user to key in a password.

The triggering device 2 comprises a housing 21, a seat 22 disposed in the housing 21, a conductive elastic member 23 located on the seat 22, and a movable conductive post 24 urged by the elastic member 23 to protrude outward and function as a movable part outside the housing 21. A fixed conductive plate 25 is provided in the housing 21 and located on the sliding way of the movable conductive post 24. The fixed conductive plate 25 and the conductive elastic member 23 (the movable conductive post 24) are electrically connected to the circuit board 12, respectively, via a conductive wire 26.

The relative triggering element 3 is located on the sliding way of the movable part of the triggering device 2, and has a guiding slope 31 at one side thereof adjacent to the moveable part.

Figure 3:
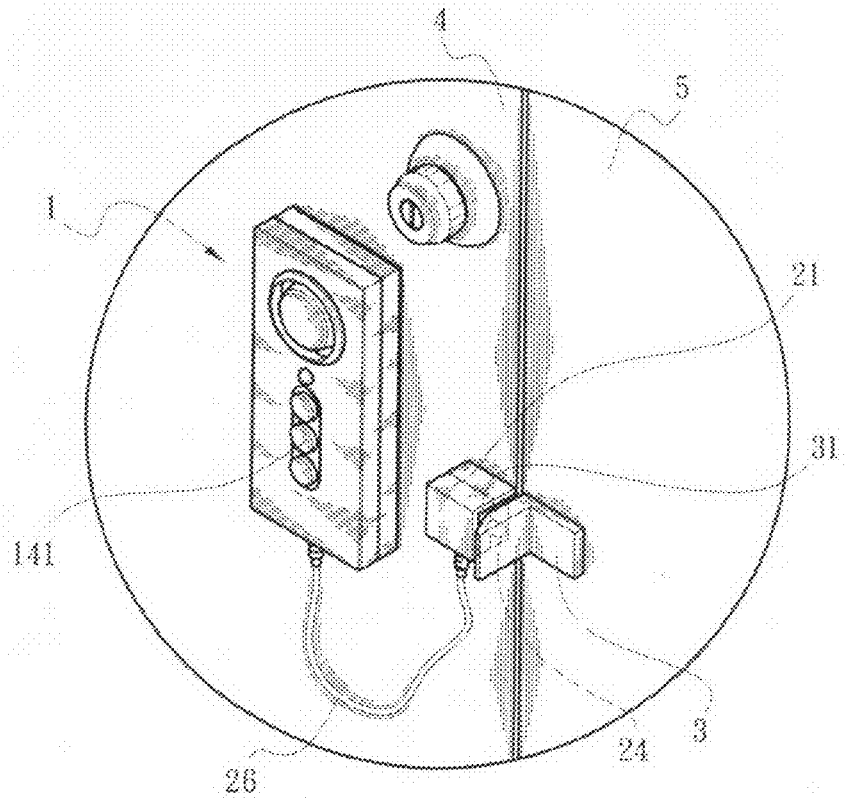
FIG. 3 is a perspective view of a preferred embodiment of the present invention, illustrating its application to a gate.
Figure 4:
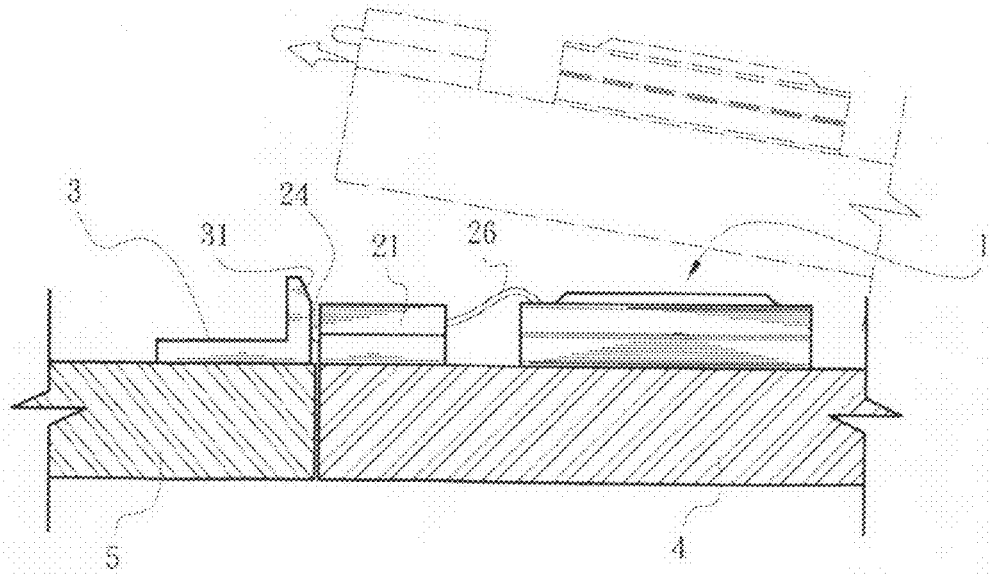
FIG. 4 is a top view of the preferred embodiment of the present invention, illustrating a triggering device in an operating state when opening the gate.
Figure 5:
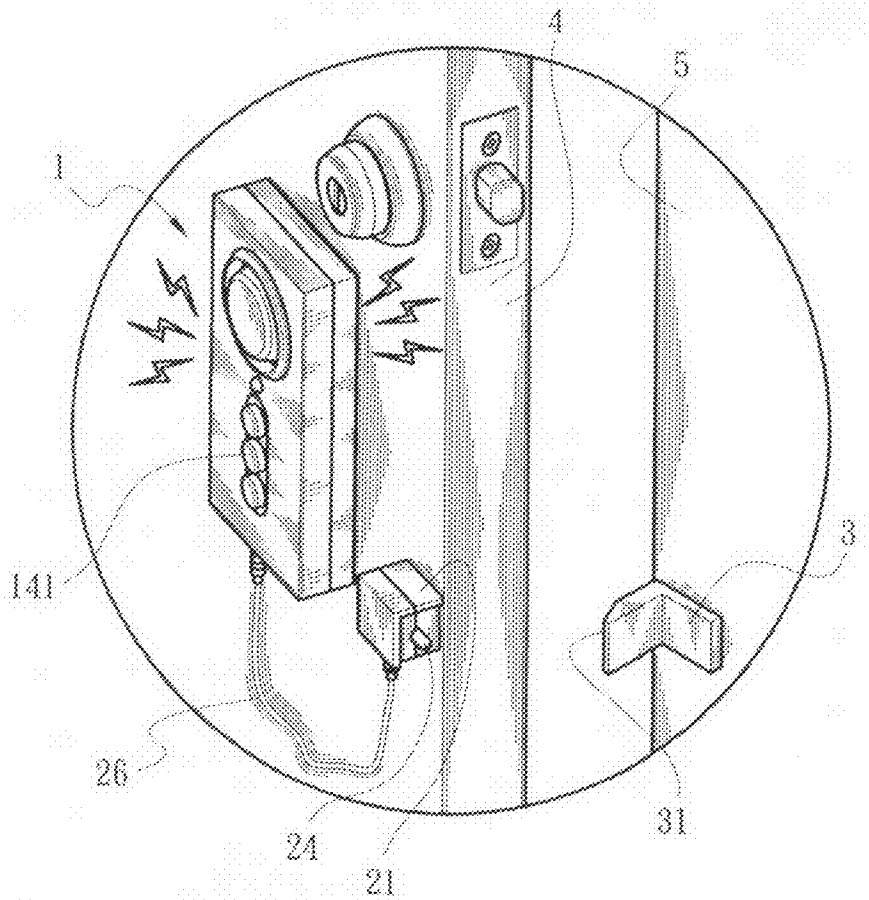
FIG. 5 is a perspective view of the preferred embodiment of the present invention, illustrating the entire operating state when opening the gate.

As shown in FIGS. 3 through 5, the housing 21 of the triggering device is secured to a gate 4 (or a doorframe 5) of the entrance of a pool area with twin adhesive 211 (or other equivalent fixing members). The case 11 of the alarm body 1 is secured near one side of the triggering device 2 with adhesive strips 116 and 117 (or other equivalent fixing members). The relative triggering element 3 is secured to the doorframe 5 (or the gate 4) corresponding in position to the triggering device 2 with twin adhesive 32. When the gate 4 is closed, the movable conductive post 24 of the triggering device 2 will engage with the relative triggering element 3; the movable conductive post 24 and the fixed conductive plate 25 will be in an open circuit, and the circuit board 12 will not receive any triggering signal. When the gate 4 is open, the movable conductive post 24 will disengage from the relative triggering element 3 and protrude outward to be contact with the fixed conductive plate 25 and produce a triggering signal to the circuit board 12 via the guiding wire 26.

When the alarm mode of the alarm body 1 is not lifted and the gate 4 is open, the movable conductive post 24 of the triggering device 2 will activate and produce a triggering signal to the circuit board 12. After a predetermined time of about 7 seconds, the circuit board 12 will activate the illuminating member 15 and the sound member 13 to produce an alarm sound and light effect (such as continuous sound and light). The sound and light effect may be repeated after a period of time, for instance 30 seconds, until the energy of the battery 6 is exhausted, providing an alarm effect to prevent unauthorized persons from entry. When an authorized person keys in a predetermined pass code via the buttons 14 before opening the gate 4 (or after opening the gate 4), the alarm mode will be bypassed to prevent the illuminating member 15 and the sound member 13 from working, providing a door guard to detect a stranger. When the gate 4 is open under this situation then the alarm mode is lifted and the gate 4 is not closed within a period of time, the alarm member 15 and the sound member 13 will produce another alarm sound and light effect (such as intermittent sound and twinkling light) to remind the operator that the gate 4 is not closed. When the alarm body 1 is lifted and the gate 4 is open and then closed, the alarm body 1 will be automatically set in an alarm mode within a predetermined time. Furthermore, when the battery 6 runs short of energy, the illuminating member 15 and the sound member 13 of the alarm body 1 will produce another different sound and light effect (such as a short time of buzzing sound and twinkling light) to remind the user to replace the battery 6.

The aforementioned alarm's operation, design and upgraded bypass code system differentiate it from the present invention. Different assembly and change could provide the same efficacy when in use.

The purpose of the present invention is to provide an alarm device to guard a pool, spa or other area. It is designed to prevent unauthorized persons from entering the pool or other protected area and sound an alarm when an unauthorized person enters the pool or protected area. Although the present invention has been shown and described with respect to the preferred embodiment, it will be understood by those skilled in the art that various changes and modifications may be made without departing from the spirit and scope of the invention as defined in the following claims.

What is claimed is:

1. A pool guard alarm apparatus, comprising:

an alarm body, having a case to accommodate a circuit board and a battery for providing power source, the circuit board comprising several buttons and a sound member, the buttons protruding outward from the case for enabling an operator to key in a pass code and to bypass an alarm mode;

a relative triggering element, located on either of a gate and a doorframe at the entrance of an area around a pool; and a triggering device, located on either of the gate and the doorframe, corresponding to the relative triggering element, the triggering device comprising a movable part which is elastic and retractable to change an engaging state with respect to the relative triggering element upon opening or closing of the gate, thereby producing a triggering signal to the circuit board, the circuit board when in the alarm mode activating the sound member to produce an alarm sound after a predetermined time, wherein the movable part of the triggering device is a movable conductive post driven by a conductive elastic member, a fixed conductive plate being provided on the sliding way of the movable conductive post, the fixed conductive plate and the movable conductive post being electrically connected to the circuit board respectively, the movable conductive post disengaging with the fixed conductive plate when the movable conductive post is against the relative triggering element, the movable conductive post urged by the conductive elastic member being in contact with the fixed conductive plate to produce a triggering signal when the movable conductive post is not against the relative triggering element.

2. The pool guard alarm apparatus as claimed in claim 1, wherein the circuit board is provided with an illuminating member to produce an alarm light.

3. The pool guard alarm apparatus as claimed in claim 1, wherein the circuit board is provided with an illuminating member to produce an alarm light.

4. The pool guard alarm apparatus as claimed in claim 1, wherein the alarm sound is repeated after a period of time when in the alarm mode.

5. The pool guard alarm apparatus as claimed in claim 1, wherein the alarm sound is repeated after a period of time when in the alarm mode.

6. The pool guard alarm apparatus as claimed in claim 2, wherein the alarm sound is repeated after a period of time under the alarm mode.

7. The pool guard alarm apparatus as claimed in claim 3, wherein the alarm sound is repeated after a period of time under the alarm mode.

8. The pool guard alarm apparatus as claimed in claim 1, wherein the circuit board drives the sound member to produce a different alarm sound when the alarm mode is bypassed and the gate is opened.

9. The pool guard alarm apparatus as claimed in claim 1, wherein the circuit board drives the sound member to produce a different alarm sound when the alarm mode is bypassed and the gate is opened.

10. The pool guard alarm apparatus as claimed in claim 2, wherein the circuit board drives the sound member to produce a different alarm sound when the alarm mode is bypassed and the gate is opened.

11. The pool guard alarm apparatus as claimed in claim 3, wherein the circuit board drives the sound member to produce a different alarm sound when the alarm mode is bypassed and the gate is opened.

12. The pool guard alarm apparatus as claimed in claim 4, wherein the circuit board drives the sound member to produce a different alarm sound when the alarm mode is bypassed and the gate is opened.

13. The pool guard alarm apparatus as claimed in claim 5, wherein the circuit board drives the sound member to produce a different alarm sound when the alarm mode is bypassed and the gate is opened.

14. The pool guard alarm apparatus as claimed in claim 6, wherein the circuit board drives the sound member to produce a different alarm sound when the alarm mode is bypassed and the gate is opened.

15. The pool guard alarm apparatus as claimed in claim 7, wherein the circuit board drives the sound member to produce a different alarm sound when the alarm mode is bypassed and the gate is opened.

* * * * *